United States Patent [19]

Ogihara et al.

[11] 4,367,693

[45] Jan. 11, 1983

[54] DEVELOPMENT APPARATUS

[75] Inventors: Masato Ogihara; Masamitsu Tsubaki, both of Sagamihara, Japan

[73] Assignee: Ricoh Company, Ltd., Tokyo, Japan

[21] Appl. No.: 202,162

[22] Filed: Oct. 30, 1980

[30] Foreign Application Priority Data

Nov. 20, 1979 [JP] Japan ..... 54/150466

[51] Int. Cl.[3] ..... B05C 11/10; G03G 15/09

[52] U.S. Cl. ..... 118/674; 118/657; 118/658; 118/695; 318/77; 355/3 DD

[58] Field of Search ..... 118/653, 657, 658, 674, 118/695; 355/3 DD; 318/77

[56] References Cited

U.S. PATENT DOCUMENTS 3,064,173 11/1962 Breen et al. ..... 318/77 X 4,154,520 5/1979 Nishikawa et al. ..... 355/3 DD

*Primary Examiner*—Evan K. Lawrence

*Attorney, Agent, or Firm*—Guy W. Shoup; Eliot S. Gerber

[57] ABSTRACT

A dry-type development apparatus for use in a facsimile apparatus or the like, comprising a magnetic roller and a sleeve whose rotation speed is changed in accordance with the transportation speed of a latent electrostatic image bearing record sheet. The apparatus includes a pulse motor for transporting the record medium stepwise and a control system for regulating the revolutions per unit time of the magnetic roller and sleeve in accordance with the number of pulses per unit time input to the motor.

7 Claims, 3 Drawing Figures

DEVELOPMENT APPARATUS

BACKGROUND OF THE INVENTION

The present invention relates to a development apparatus for facsimile apparatus or the like.

In a conventional facsimile apparatus, particularly in a facsimile apparatus employing a data compression system, scanning for recording to image information is performed at intermittently varying speeds depending upon the presence of information to be recorded, and accordingly the recording sheet is transported intermittently. In particular, when the record sheet is transported sequentially through a recording section where the latent electrostatic image corresponding to image information transmitted is formed, and then through a development section, the record sheet has to be transported intermittently through the development section in synchronization with the transportation thereof through the recording section. Therefore, when the development is performed by a dry-type copying machine of the type comprising a non-magnetic sleeve with an inner magnetic roller being rotated continuously at a predetermined speed, the condition for developing the image on the record sheet may vary due to the intermittent movement of the record sheet, resulting in the image quality being degraded, particularly, the image density becoming uneven and the background of the record sheet being smeared. Further, when the record sheet is transported at extremely slow speeds, excess toner is supplied to the record sheet and accumulates near the record sheet, so that the recording section of the apparatus may become smeared with the toner.

In order to eliminate the above-mentioned shortcomings, a development apparatus in which the transportation of the record sheet and the rotation of the sleeve are accurately synchronized with each other has been proposed. However, this development apparatus requires an expensive pulse motor as its drive source. According to the experiments conducted by the inventors of the present invention, using the above-mentioned development apparatus, the image quality was not degraded when the sleeve was rotated, but when the magnetic roller was rotated, the image quality was so degraded that it could not be used in practice.

SUMMARY OF THE INVENTION

It is therefore an object of the invention to provide a development apparatus for facsimile apparatus or the like, in which the rotation speeds of an inner magnetic roller and a non-magnetic sleeve are varied in semi-synchronization with the transportation speed of the record sheet.

According to the invention, optimum, even development can be obtained automatically irrespective of uneven, intermittent transportation of the record sheet, such transportation being in accordance with the density of images to be developed, and therefore the degrading of image quality and the accumulation of toner near the record sheet are prevented. Furthermore, the development apparatus according to the invention is inexpensive.

DESCRIPTION OF THE PREFERRED EMBODIMENT

An embodiment of a development apparatus according to the invention is a dry type development apparatus comprising detection means for detecting the transportation speed of a record sheet and speed variation means for varying the revolutions per unit time of a magnetic roller and a sleeve in accordance with the transportation speed detected by the detection means. As the detection means for detecting the transportation speed of the record sheet, for example, means for detecting the number of steps in the rotation per unit time of a pulse motor for transporting the record sheet is employed. As the drive means for rotating the magnetic roller and the sleeve at the same speed, for example, a D.C. motor is employed, and the revolutions per unit time of the magnetic roller and the sleeve are changed by changing the drive voltage applied to the D.C. motor. In this embodiment, when the record sheet transportation speed is high, the revolutions of the magnetic roller and the sleeve per unit time are increased; when the record sheet transportation speed is low, the revolutions of the magnetic roller and the sleeve per unit time are decreased; and when the record sheet is stopped, the magnetic roller and the sleeve are rotated at a predetermined speed; thus semi-synchronization is retained between the record sheet transportation speed and the revolutions of the magnetic roller and the sleeve.

Figure 1:
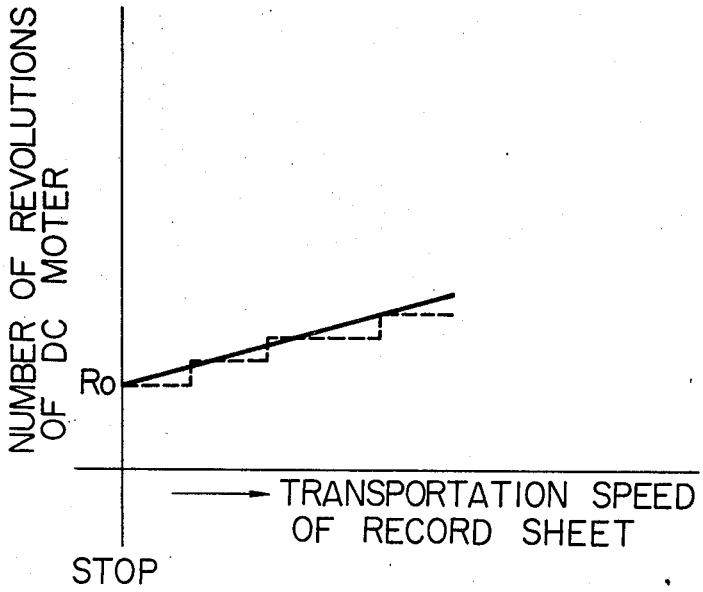
FIG. 1 is a graph for explaining the invention, showing the relationship between the revolutions of a D.C. motor for driving a non-magnetic sleeve or the inner magnetic roller thereof and the transportation speed of a record sheet.

As shown in FIG. 1, when the record sheet is stopped, the D.C. motor is rotated at $R_0$ r.p.m. When the record sheet is transported at a low speed by decreasing the number of steps per unit time of the pulse motor, the rotation speed of the D.C. motor is decreased, while when the record sheet is transported at a high speed by increasing the number of steps per unit time of the pulse motor, the rotation speed of the D.C. motor is increased continuously or stepwise as the transportation speed of the record sheet is increased.

Figure 2:
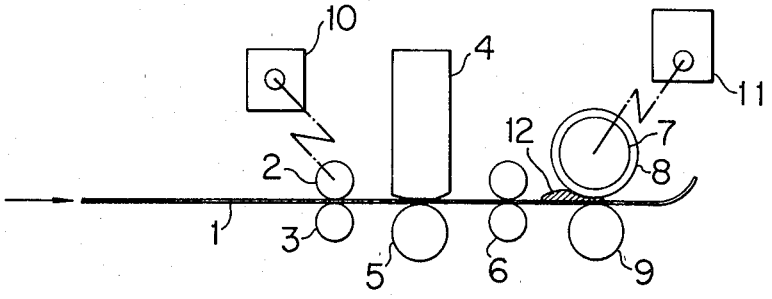
FIG. 2 is a schematic side view of an embodiment of a development apparatus according to the invention.

Referring to FIG. 2, there is shown a embodiment of a development apparatus of the invention. A record sheet 1 is transported in the direction of the arrow by a transportation roller 2 and a pressure application roller 3 in a recording section, and a latent electrostatic image is formed on the record sheet 1 by styli 4 and a back roller 5. The record sheet 1 is then caused to pass through a pair of transportation rollers 6 and transported into a conventional development section comprising a sleeve 8 with an inner magnetic roller 7, and a gap roller 9, where the latent electrostatic image is developed by the sleeve 8 with the inner magnetic roller 7, with the toner for the development being supplied from a developer feed section (not shown). A pulse motor 10 drives the transportation roller 2 stepwise whenever a pulse signal is applied thereto, so that the record sheet 1 is transported intermittently through the record section. The development section is located just behind the recording section, and the record sheet 1 is transported intermittently through the development section by the pulse motor 10. The magnetic roller 7 and the sleeve 8 are rotated by a D.C. motor 11. The rotation speed of the D.C. motor 11 is controlled by a control circuit shown in FIG. 3 in such a manner that the revolutions of the D.C. motor 11 per unit time increases as the number of steps in the rotation of the pulse motor 10 increases.

Figure 3:
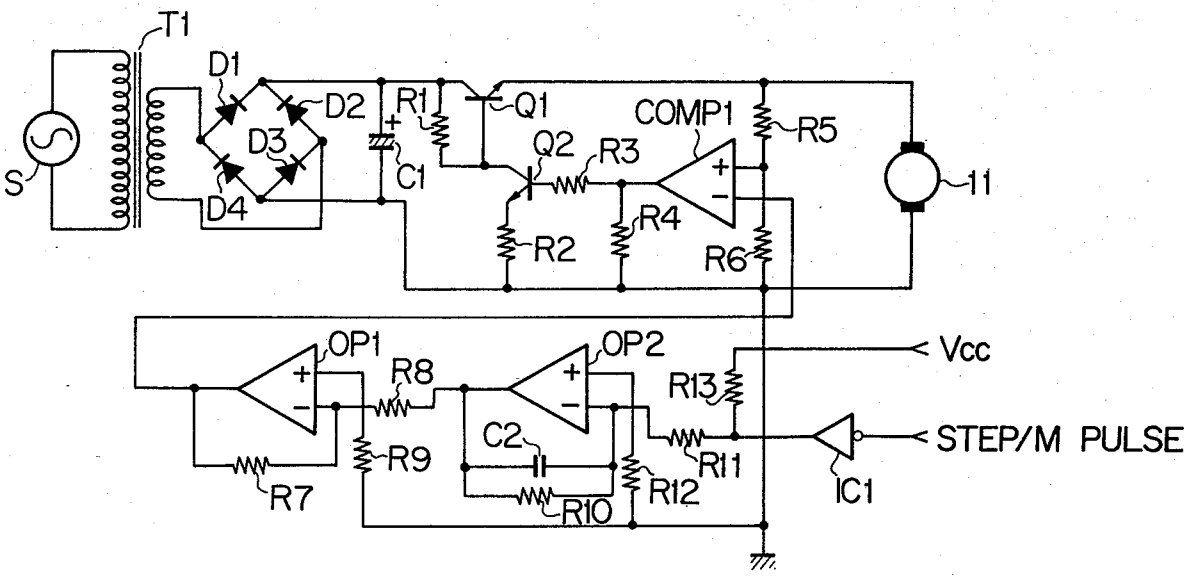
FIG. 3 is a circuit diagram of a speed control circuit of the development apparatus in FIG. 2.

In FIG. 3, S represents an A.C. power source; T1 a transformer; D1–D4 diodes; C1 and C2 condensers; Q1 and Q2 transistors; COMP1 a comparator; OP1 and OP2 operational amplifiers; IC1 an open collector inverter; and R1–R13 resistors.

The 100 V output of the A.C. power source S is converted to an appropriate voltage by the transformer T1 and is then subjected to full wave rectification by the diodes D1–D4 and smoothed by the condenser C1 to be converted to a D.C. voltage, which is applied to the D.C. motor 11 through the transistor Q1 for series control. The pulse signal STEP/M PULSE at a TTL level drives the pulse motor 10. When one pulse of the signal is applied to the pulse motor 10, the pulse motor 10 is rotated by one step, and the pulse is maintained at a high level equal to a power source level, Vcc by the open collector inverter IC1 and is then input to the operational amplifier OP2. Since the operational amplifier OP2 and the condenser C2 constitute an integrating circuit, the pulse signal generated from the open collector inverter IC1 are converted to a signal whose voltage level changes in accordance with the number of pulses generated per unit time. The converted signal is amplified by the operational amplifier OP1 and is then compared with a reference voltage by the comparator COMP1. The reference voltage is a voltage divided by the resistors R5 and R6 across the two terminals of D.C. motor 11. The transistor Q2 controls the transistor Q1 in accordance with the output signal of the comparator COMP1. Therefore, the transistor Q1 controls the voltage across the two terminals of the D.C. motor 11 by the density of the pulses of the pulse signal STP/M PULSE. Since the rotation speed of the D.C. motor 11 is proportional to the voltage across the two terminals of the D.C. motor 11, the rotation speed of the D.C. motor 11 changes in accordance with the density of the pulses of the signal STEP/M PULSE, so that the revolutions per unit time of the magnetic roller 7 and the sleeve 8 are varied, depending upon the transportation speed of the record sheet, whereby the developing of the image on the record sheet can be uniformly obtained in accordance with the intermittent movement of the record sheet, and the degrading of the image quality and the accumulation of toner 12 (FIG. 2) on the record sheet can be prevented. Furthermore, according to the invention, inexpensive development apparatus can be made, using the D.C. motor.

What is claimed is:

1. A development apparatus comprising a sleeve for applying magnetic toner to a movable record medium, pulse motor means for stepwise transporting said record medium in accordance with pulses input thereto, a magnetic roller disposed within said sleeve, at least one of said sleeve and said magnetic roller being a rotatable member; drive means for rotating said rotatable member and speed variation means for changing the revolutions per unit time of said rotatable member in accordance with the number of said pulses per unit time input to said pulse motor means.

2. A development apparatus as in claim 1, wherein said speed variation means comprises detection means for detecting the transportation speed of said record medium by detecting said pulses per unit time input and control means for controlling said drive means in accordance with the output signal generated from said detection means.

3. A development apparatus as in claim 1, wherein said drive means comprises a D.C. motor.

4. A development apparatus comprising a rotatable cylindrical non-magnetic sleeve for applying magnetic toner to a movable record medium, a magnetic roller disposed within said sleeve, drive means including a D.C. motor for rotating said sleeve, pulse motor means for transporting said record medium in accordance with pulses input thereto, and speed variation means for changing the rotational speed of said D.C. motor in accordance with the transportation speed of said record medium; wherein said record medium is transported stepwise by said pulse motor means in accordance with pulses input thereto and the speed of said D.C. motor is changed in accordance with the number of said pulses to the pulse motor means per unit time.

5. A development apparatus as in claim 4, wherein said speed variation means comprises detection means for detecting the transportation speed of said record medium by detecting said pulses per unit time input and control means for controlling said D.C. motor in accordance with the output signal generated from said detection means.

6. A development apparatus comprising a cylindrical non-magnetic sleeve for applying magnetic toner to a movable record medium, a rotatable magnetic roller disposed within said sleeve, drive means including a D.C. motor for rotating said magnetic roller, pulse motor means for transporting said record medium in accordance with pulses input thereto, and speed variation means for changing the rotational speed of said D.C. motor in accordance with the transportation speed of said record medium; wherein said record medium is transported stepwise by said pulse motor means in accordance with pulses input thereto and the speed of said D.C. motor is changed in accordance with the number of said pulses to the pulse motor means per unit time.

7. A development apparatus as in claim 6, wherein said speed variation means comprises detection means for detecting the transportation speed of said record medium by detecting said pulses per unit time input and control means for controlling said D.C. motor in accordance with the output signal generated from said detection means.

* * * * *